US008115398B2

(12) United States Patent
Draaijer et al.

(10) Patent No.: US 8,115,398 B2
(45) Date of Patent: Feb. 14, 2012

(54) SYSTEM AND METHOD FOR PERFORMING AN ILLUMINATION COPY AND PASTE OPERATION IN A LIGHTING SYSTEM

(75) Inventors: Maurice H. J. Draaijer, Eindhoven (NL); Sel-Brian Colak, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 411 days.

(21) Appl. No.: 12/439,239

(22) PCT Filed: Sep. 3, 2007

(86) PCT No.: PCT/IB2007/053543

§ 371 (c)(1), (2), (4) Date: Feb. 27, 2009

(87) PCT Pub. No.: WO2008/032236

PCT Pub. Date: Mar. 20, 2008

(65) Prior Publication Data

US 2009/0267524 A1 Oct. 29, 2009

(30) Foreign Application Priority Data

Sep. 12, 2006 (EP) ..... 06120533

(51) Int. Cl.
*H05B 37/02* (2006.01)

(52) U.S. Cl. ... 315/152; 315/153; 250/205; 340/539.32; 340/540

(58) Field of Classification Search ..... 315/152–158, 315/291, 307, 308, 312; 340/540, 541, 683, 340/539, 32; 250/205
See application file for complete search history.

(56) References Cited

U.S. PATENT DOCUMENTS

| | | | | |
|---|---|---|---|---|
| 7,526,126 | B2 * | 4/2009 | Oon et al. | 382/167 |
| 7,598,859 | B2 * | 10/2009 | Laski et al. | 340/539.3 |
| 7,614,763 | B2 * | 11/2009 | Leibinger et al. | 362/235 |
| 2001/0007505 | A1 | 7/2001 | Lee et al. | |
| 2004/0129860 | A1 * | 7/2004 | Thibaud et al. | 250/205 |
| 2006/0018118 | A1 | 1/2006 | Lee et al. | |

FOREIGN PATENT DOCUMENTS

| | | | |
|---|---|---|---|
| EP | 1610593 | A2 | 12/2005 |
| EP | 1619934 | A1 | 1/2006 |
| WO | 0188434 | A1 | 11/2001 |
| WO | 2004057927 | A1 | 7/2004 |
| WO | 2007125477 | A2 | 11/2007 |
| WO | 2009010916 | A2 | 1/2009 |

* cited by examiner

*Primary Examiner* — Jacob Y Choi
*Assistant Examiner* — Jimmy Vu
(74) *Attorney, Agent, or Firm* — Mark L. Beloborodov

(57) ABSTRACT

The invention relates to copying light conditions from one location and pasting into or providing similar light conditions to another location in a lighting system. A light detector (20) is provided which comprises a first sensor (50) configured to receive a first light directly from a first light source (14) and measure first light attributes of the first light, and a second sensor (52) configured to receive the first light influenced by reflections from surfaces (24) and measure second light attributes of the first light. Processing means (16) are adapted to process perceivable light attributes at the first location (22, 24) from the first light attributes and the second light attributes, and in conjunction with the specification of the second light source (15) to control the second light source (15) to provide the second light having light attributes at the second location (23, 25) that substantially match the perceivable light attributes at the first location (22, 24), whereby the illumination at the first location (22, 24) may be copied and pasted to the second location (23, 25).

6 Claims, 3 Drawing Sheets

SYSTEM AND METHOD FOR PERFORMING AN ILLUMINATION COPY AND PASTE OPERATION IN A LIGHTING SYSTEM

This application is a national stage application under 35 U.S.C. §371 of International Application No. PCT/IB2007/053543 filed on Sep. 3, 2007, and published in the English language on Mar. 20, 2008 as International Publication No. WO/2008/032236, which claims priority to European Application No. 06120533.2, filed on Sep. 12, 2006, incorporated herein by reference.

The invention relates to copying light conditions from one location and pasting into or providing similar light conditions to another location in a lighting system.

The adjustment of parameters such as the illumination intensity and color in modem lighting systems is often difficult and tedious due to the plurality of light sources. Therefore, specific technical methods may be used to adjust the lighting parameters, for example computer programs processing signals from sensors measuring certain light attributes, such as the intensity and color of an illumination generated by the light sources, and generating signals for controlling the light sources in order to obtain certain lighting conditions. Often it is desired in a lighting system to obtain a certain illumination in one location also in another location. This requires to "copy" the illumination from the one location and to "paste" it into the other location.

EP 1 619 934 A1 discloses a color duplication method and an apparatus applying a color sensor that measures a target color. A color matching mechanism controls a color projection mechanism to change the color of the object to match the target color. Thus, the color of an object may be adjusted in that it matches a target color.

It is an object of the present invention to provide an improved system and method for performing an illumination copy and paste operation. In order to achieve the object defined above, the invention provides a system for performing an illumination copy and paste operation in a lighting system comprising

- a first light source adapted to provide a first light for illuminating a first location,
- a second light source adapted to provide a second light for illuminating a second location,
- a light detector comprising
- a first sensor configured to receive the first light directly from the first light source and measure first light attributes of the first light and
- a second sensor configured to receive the first light influenced by reflections from surfaces and measure second light attributes of the first light,
- a memory configured to store a database including a specification of the second light source,
- processing means adapted to process perceivable light attributes at the first location from the first light attributes and the second light attributes, and in conjunction with the specification of the second light source to control the second light source to provide the second light having light attributes at the second location that substantially match the perceivable light attributes at the first location, whereby the illumination at the first location may be copied and pasted to the second location.

In order to achieve the object defined above, the invention also provides a method for performing an illumination copy and paste operation in a lighting system comprising the steps of

- providing a first light for illuminating a first location,
- providing a second light for illuminating a second location,

- receiving the first light directly from the first light source and measuring first light attributes of the first light and
- receiving the first light influenced by reflections from surfaces and measuring second light attributes of the first light,
- storing a database including a specification of the second light source,
- processing perceivable light attributes at the first location from the first light attributes and the second light attributes, and in conjunction with the specification of the second light source controlling the second light source to provide the second light having light attributes at the second location that substantially match the perceivable light attributes at the first location.

An illumination copy and paste system and a corresponding method are described in the European patent application EP06113411.0 of the applicant filed on May 3, 2006. In this application, the copy and paste operation is based on a lightwave identification of the direct light from light sources without taking into account any reflections influencing the perceivable light conditions at the copy, i.e. the first location. In contrast to his, the characteristic features according to the present invention provide the advantage that reflections are considered when an illumination is copied from the first location and pasted to the second location. This may result in a high accuracy of the illumination copy and paste operation with regard to the perceived light (color). According to the present invention, the reflections of light from surfaces are detected with a second sensor in addition to a first sensor for measuring the light directly coming from a light source. The second sensor is configured such that it only receives the first light influenced by reflections from surfaces, while the first sensor receives light directly from the light source.

According to an embodiment of the invention, the processing means may be further adapted

- to calculate the surface color reflection spectrum from the first light attributes and the second light attributes,
- to compute an adjustment color spectrum from the calculated surface color reflection spectrum and the first and second light attributes, and
- to control the second light source based on the computed adjustment color spectrum.

The advantage of the measurement of the first and second light conditions is that it enables the determination of the reflection spectrum at the first or copy location. This further allows to calculate an adjustment color spectrum for the second light source, and the second or paste location. The purpose of this adjustment color spectrum is to adapt the illumination at the second or paste location such that it essentially matches the illumination at the first or copy location. The adjustment color spectrum allows to take the reflections on the copy location into account when the illumination is pasted into the second or paste location.

According to a further embodiment of the invention, the processing means may be further adapted

- to calculate the surface color reflection spectrum from the first light attributes and the second light attributes by subtracting the color spectrum measured with the second sensor from the color spectrum measured with the first sensor.

Typically, reflecting surface may cause a shift in the color spectrum of the first light measured by the second sensor. The influence of a reflecting surface may be determined by the subtraction of the two color spectrum measured with both sensors.

According to a yet further embodiment of the invention, the system may further comprise a light detector comprising a first sensor configured to receive the second light directly from the second light source and measure first light attributes of the second light and a second sensor configured to receive the second light influenced by reflections from surfaces and measure second light attributes of the second light, wherein the processing means are further adapted to process perceivable light attributes at the second location from the first light attributes and the second light attributes of the second light, and in conjunction with the perceivable light attributes at the second location to adjust the second light source to provide the second light having light attributes at the second location that substantially match the perceivable light attributes at the first location.

In order to further improve the illumination copy and paste operation, the illumination at the second or paste location may detected with the light detector. The measurements of the light from the second light source at the second or paste location may then be used to adjust the second light in order to better match the perceivable light attributes at the first or copy location.

According to an embodiment of the invention, the adjustment of the second light source comprises iteratively repeating the following steps until the light attributes of the second light at the second location merely differ from the perceivable light attributes at the first location by a predefined minimum deviation:

measuring the first and second light attributes of the second light with the second light detector at the second location, transmitting the measured first and second light attributes to the processing means, processing the received first and second light attributes of the second light and the first and second light attributes of the first light in order to determine a deviation, if the deviation exceeds the predefined minimum deviation, adjusting the second light source in correspondence with the processed deviation.

According to a further embodiment of the invention, a light detector is provided which is adapted for a system according to the invention and which comprises a first sensor configured to receive the first light directly from the first light source and measure first light attributes of the first light and a second sensor configured to receive the first light influenced by reflections from surfaces and measure second light attributes of the first light.

According to an embodiment of the invention, the first and second sensor are color sensitive sensors.

According to a further embodiment of the invention, the light detector may further comprise a decoder for decoding a code contained in the received first light and an internal memory for storing the code, and a transmitter for transmitting the stored code to the processing means.

According to an embodiment of the invention, a lighting controller is provided which may be adapted for usage with a system according to the invention and which comprises the processing means, and receiving means adapted for receiving a copy signal and a paste signal from the light detector.

According to a further embodiment of the invention, the lighting controller may be further adapted to communicate with the light detector via a wireless communication link.

According to a further embodiment of the invention, a computer program is provided, wherein the computer program may be enabled to carry out the method according to the invention when executed by a computer. The computer program allows to implement the invention for example in a Personal Computer (PC) which may be used for controlling a complex lighting system.

According to an embodiment of the invention, a record carrier such as a CD-ROM, DVD, memory card, floppy disk or similar storage medium may be provided for storing a computer program according to the invention.

These and other aspects of the invention will be apparent from and elucidated with reference to the embodiment(s) described hereinafter.

The invention will be described in more detail hereinafter with reference to exemplary embodiments. However, the invention is not limited to these exemplary embodiments.

In the following description (functional) similar and/or identical elements may be denoted with the same reference numerals.

Figure 1:
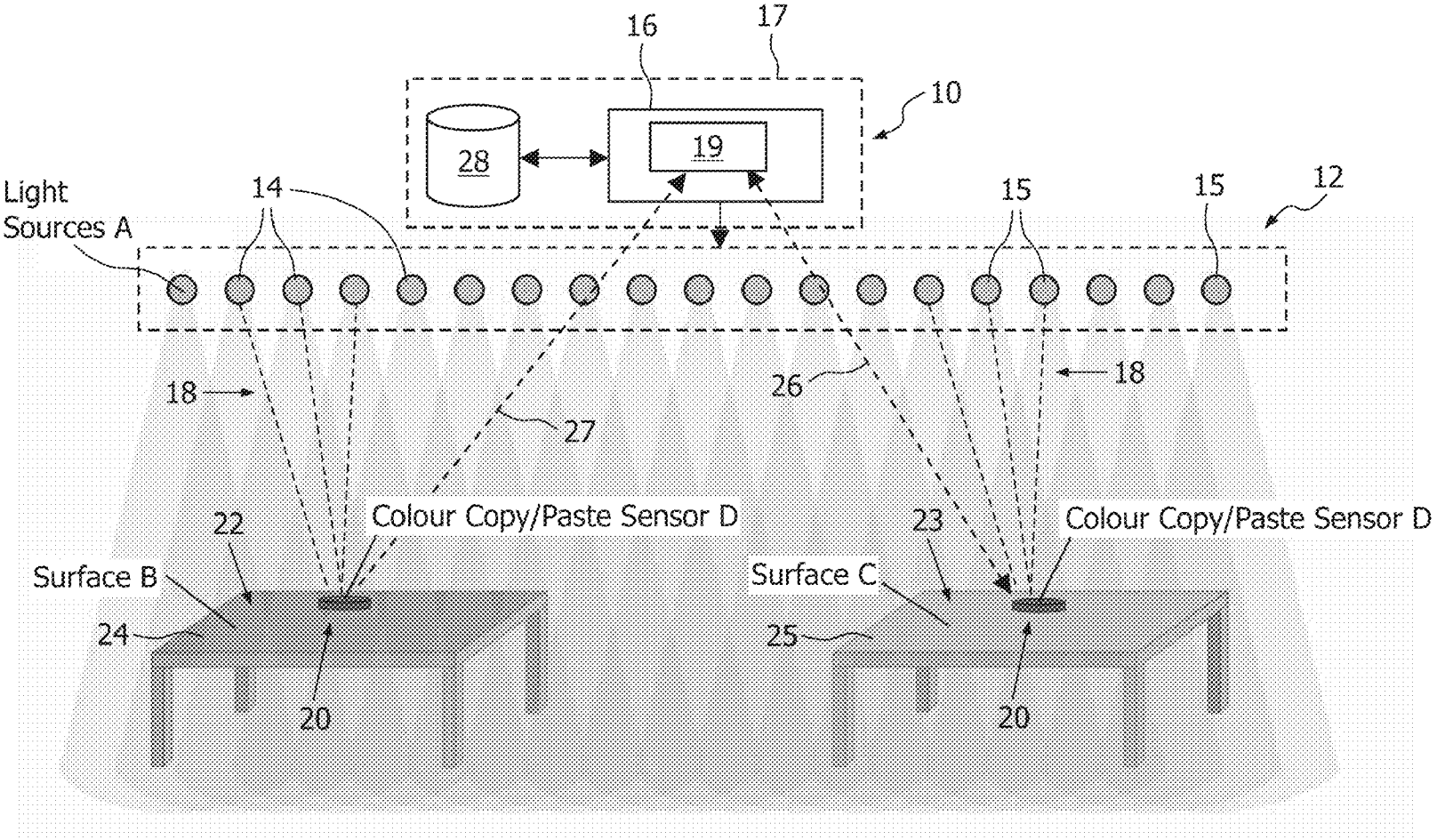
FIG. 1 shows a lighting system configured for an illumination copy and paste operation of an illumination of a first table into an illumination of a second table by means of a light detector according to an embodiment of the invention.

In FIG. 1, a lighting system 10 comprises a ceiling 12 with equally spaced light sources, here LEDs, which can be controlled by a (lighting) controller 17 of the lighting system 10. Only the light intensity is controlled per individual light source compromising a DC output plus modulation, for example CDMA coded signals 18 for identification purposes of the individual light sources at a receiver side D, for example by a light detector 20 placed on the surface 22 of a first table 24, which is illuminated by first light sources 14 located above the table 24 in the ceiling 12.

The light detector 20 serves to identify the received light from the first light sources 14 by decoding the CDMA coded signals 18 contained in the received light. Thus, the detector 20 comprises a CDMA decoder (not shown) for decoding the CDMA coded signals 18 contained in the light generated from the first light sources 14. Decoding may be for example activated by pressing a copy button of the light detector 20. The light detector 20 may internally store the decoded signals 18 for an illumination copy and paste operation. Alternatively, the detector 20 may transmit the decoded signals 18 as an illumination copy signal 27 to receiving means 19 contained in processing means 16 of the controller 17. After receipt of the illumination copy signal 27, the processing means 16 may store the decoded signals 18 received with the illumination copy signal 27 together with the driving parameters such as current and duty cycle of the light sources 14 in the database 28 for a latter paste operation. As mentioned above, the light detector 20 is particularly able to recognize which individual first light sources 14 are enabled by the light controller 17. For the illumination copy operation, the CDMA coded signals 18 of all the first light sources 14 or LEDs incident on the surface 22 are measured by the light detector 20, particularly together with their operation characteristics such as the duty cycle.

The paste operation is shown for the surface 23 of a second table 25, which is illuminated by second light sources 15 located above the table 25 in the ceiling 12. The paste operation may be performed with the light detector 20. When the light detector 20 is located on the surface 22 of the first table, it detects the incident light from the first light sources 14 on the surface 22 by decoding the CDMA coded signals 18 and stores the identification of each individual first light source 14 transmitted with the CDMA coded signals 18. Thus, the light detector 20 "knows" which of the first light sources 14 were activated by the controller 17 of the lighting system 10 when illuminating the first table 24. In order to paste the illumination of the first table 24 to the second table 25, the light detector 20 is located on the surface 23 of the second table 25 and may transmit an illumination paste signal 26 to the controller 17 of the lighting system 10, for example upon activation of a paste button of the light detector 20. The illumination paste signal 26 may contain the information about the illumination of the first table 24 which was detected by the light detector 20 when lying on the surface 22 of the first table 24 and stored internally in the light detector 20. Alternatively, the illumination paste signal 26 may initiate the illumination copy and paste operation by the light controller 16.

Upon receipt of illumination paste signal 26, the processing means 16 of the light controller 17 load from a database 28 the operation characteristics of the first light sources 14 for creating the detected illumination of the first table 24. Then, the controller 17 activates and adjusts second light sources 15 for creating an illumination of the second table 25 which substantially matches the illumination of the first table 24. Particularly, the color of the second light sources 15 or LEDs and their parameters such as the duty cycle are adjusted so that the desired illumination of the first table 24 is obtained for the second table 25. A detailed description of the copy and paste operation and the different embodiments of this operation can be found in the above mentioned European patent application EP06113411.0 of the applicant.

In the above described way, a user of the lighting system 10 can copy and paste the emitted light intensity by the first sources 14 on specific spots as a first order approximation without tuning for reflections effects from the surfaces such as the table surfaces 22 and 23. However, the reflections of light from these surfaces influence the perceivable light attributes at the locations such as the perceivable colors. For example a colored surface of the table influences the color spectrum of light reflections from this surface since the colored surface reflects only a certain color spectrum and attenuates the remaining parts of the color spectrum. Therefore, a user perceives the entire illumination due to these reflections differently than the direct light from the light source.

Figure 2:
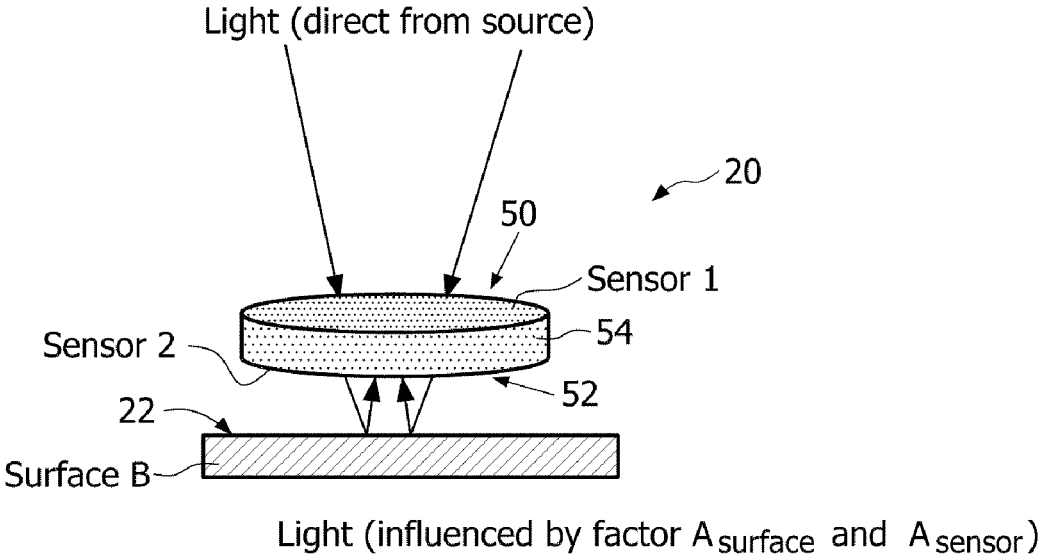
FIG. 2 shows an embodiment of a light detector with two sensors according to the invention, adapted for usage with a lighting system shown in FIG. 1.

In the following it is described how the perceived light color, seen by the viewer as affected by the nearby reflecting surfaces, may be copied and pasted according to the invention. Thus, the copy and paste operation as known from the European patent application EP06113411.0 may be improved. For this, in principle, a light detector is applied which can distinguish differences in the reflected colors. This light detector may be color sensitive. FIG. 2 shows the light detector 20, adapted to distinguish differences in the reflected colors, in detail. The detector 20 comprises a first sensor 50 "Sensor 1" which is capable of measuring (in the copy action) the amount of received light from every individual first light source 14. A second sensor 52 "Sensor 2" measures the light from the first light sources 14, influenced by the reflection from surface "Surface B" 22.

Thus, the input of two sensors 50 and 52 is available for the copy and paste operation which allows to more distinctively adapt the illumination at the paste location as will be explained below in more detail. The first sensor 50 operates as a straightforward measurement device for light directly coming from the first light sources 14. The second sensor 52 on the other hand can measure the perceived color changes in the illumination due to the surface "surface B" 22. Thus, the second sensor 52 allows to detect or measure the influence of the surface 22 on the perceived color of the illumination. This makes it possible to correct the light settings of the second light sources 15 in the paste action according to the paste location.

In the copy location "Surface C" 23, the light detector 20 has two functions. The first function is to measure the unperturbed copy colors coming from the second light sources 15. However, since the reflection color on the new surface "Surface C" 23 is different, this will enforce the settings of the second light sources 15 illuminating this surface 23 to take into account these color changes so that the resulting observable color is the same on both surfaces 22 and 23. In other words, the light settings can be corrected by the processing means 16 in order to have a perceived light color correction on the paste location on "surface B" 23 which is closer (from a perception point of view) to the perceived color from the copy location on "Surface A" 22. Therefore, the second function of the light detector 20 is to initiate the correction of the light settings of the second light sources 15 by the processing means 16 until they create an illumination at the paste location at surface 23 which closely matches the illumination at the copy location on surface 22. In order to achieve a closely matching illumination at the paste location on surface 23, the operation of the color matching procedure according to this invention may comprise more number of matching iterations than a simple copy-paste operation which does not take reflective effects into account.

The light detector 20 as shown in FIG. 2 is capable of measuring the amount of light coming from two directions with as minimum as possible light disturbance. Therefore it is equipped with two in the visible-light spectrum sensitive sensors 50 and 52. In order to make the light disturbance as small as possible, the sensors 50 and 52 are very small and attached to a homogenous visible light transparent supporting device 54 (e.g. Perspex). There is another reason for using very small sensors: small sensors have a low internal capacitance, thus being able to be sensitive for fast changing signals (e.g. CDMA signals), which can be modulated on the emitted light.

Figure 3:
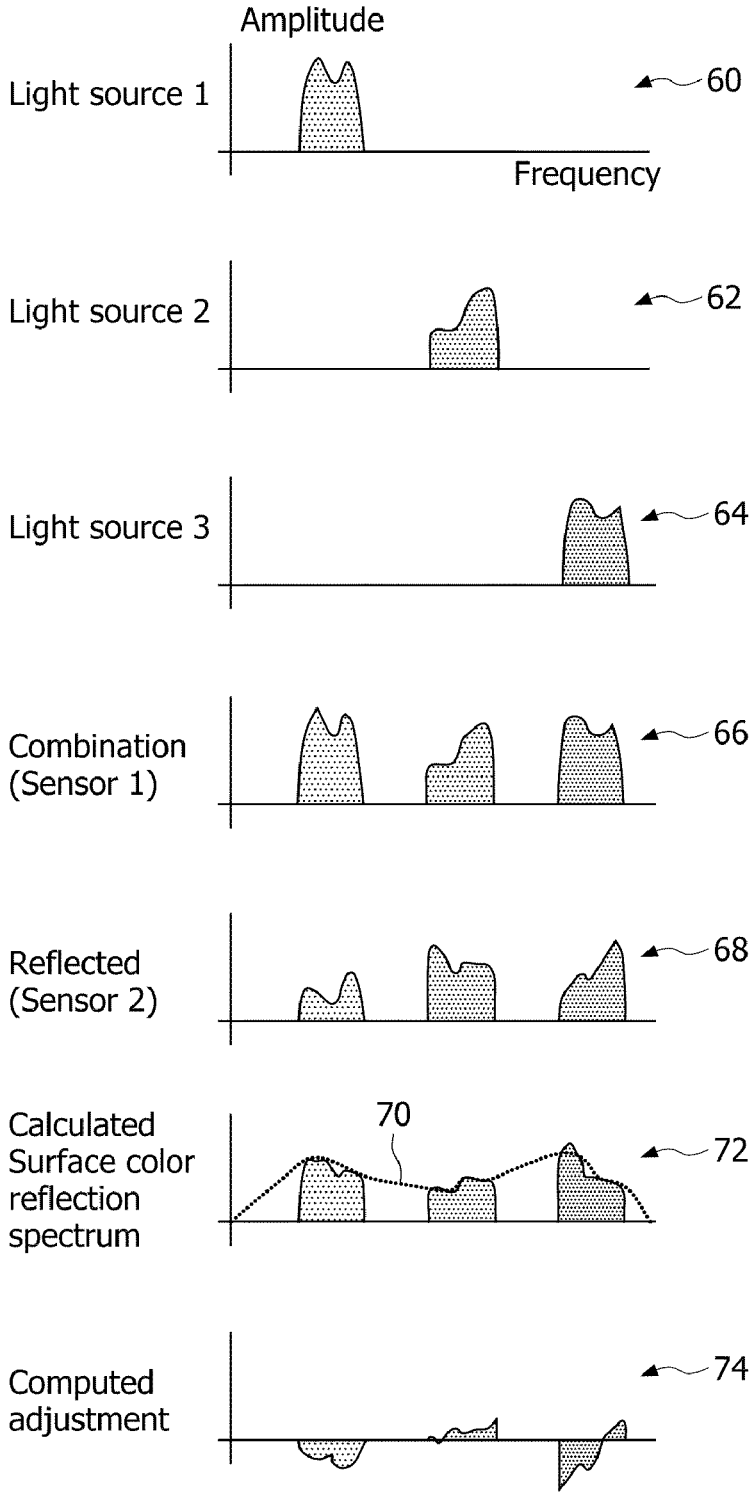
FIG. 3 shows the spectrum of lighting sources of a lighting system detected with the detector according to the invention and a computed adjustment of the spectrum for a copy and paste operation according to the invention.

FIG. 3 shows by means of color spectrum the process of copying and pasting with the light detector 20. Three light sources 1 to 3 have different spectral patterns 60, 62, and 64 in the optical domain. Sensor 50 (Sensor 1) of the light detector 20 detects a combination spectrum 66 of these three light sources 1 to 3. Both sensors 50 and 52 of the light detector 20 are light sensitive light sensors in order to detect the received light power per CDMA encoded source. The light output from a light source can be adjusted by for example pulse width modulation. It should be noted that enough power is used for the light sources to be able to detect what source is touching what surface. The other sensor 52 (Sensor 2) detects the same but reflected spectrum 68 of the light sources 1 to 3. The light spectrum detected by sensor 52 is influenced by the color and structure of the surface 22 of the first table 24. From the combination spectrum 66 and the reflection spectrum 68, a surface color spectrum 72 may be calculated. A smooth color reflection frequency spectrum behavior 70 of the object (in this case the table 24) is assumed as shown with the dotted line in the calculated surface color reflection spectrum 72. Only in the parts of the spectrum in which light sources are active it is possible to determine the color of the surface 22.

For doing the paste-action on the second table 25, the same amplitude spectrum graphs are created by correspondingly adjusting the light sources illuminating the paste location. If sensors 50 and 52 are used which have a flat frequency response, the signal-levels of the output signals of these sensors are averaged over frequency. Now a "computed adjustment" graph 74 may be calculated from the calculated surface color reflection spectrum 74 in order to closely match the reflection spectrum 68 from the copy location also at the paste location or destination. This computed adjustment graph 74 may then be used to adjust the destination light sources for a perception color copy/paste action. Although there may be imperfections because of the averaging over the spectrum shape per source, this method may be capable of adjusting the light-color on the destination surface relatively close from a human perception point of view to the perceived color on the copy surface. It should be noted that the whole process may be performed without the influence of other light sources which are not part of this complete lighting system like the sun or other light sources. In other words, only "coded" light created by light sources of the lighting system applying for example CDMA may be taken into account. However, also light from the environment may be taken into account, for example by using color sensitive sensors. By taking into account environmental light, it is also possible to compensate other light sources such as the sun or lamps not being part of the lighting system. This may be performed by switching the light sources of the lighting system off and to detect the color spectrum of the environmental light which may then be used for compensation in that the light sources of the lighting system at the paste location are controlled in correspondence with the detected color spectrum of the environmental light and the desired compensation. For example, the lighting system may comprise a kind of "environmental light influence" compensation functionality which may be enabled or disabled by a user in order to compensate the environmental lighting influences at the paste location to the perceivable color.

The invention is particularly suitable for applications in the field of the illumination control in a complex lighting system.

The invention has the main advantage that makes it more comfortable for a user to adjust an illumination created by a lighting system at a certain location by copying the desired illumination from one location and paste the copied illumination to another location at which the illumination is desired. Furthermore, the invention makes it possible to obtain an illumination at the paste location which more closely matches the illumination at the copy location than with a simply copy and paste operation which does not take into account any reflections.

At least some of the functionality of the invention such as the color matching procedure may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A lighting system configured to copy an illumination pattern from a first location and reproduce said illumination pattern to a second location, the system comprising:

a first light source configured to provide a first light for illuminating the first location, a second light source configured to provide a second light for illuminating the second location, a light detector comprising:

a first sensor configured to receive the first light substantially directly from the first light source and measure first light attributes of the first light, a second sensor configured to receive the first light at least partially reflected by one or more surfaces in the first location and measure second light attributes of the first light, a memory configured to store a database including a specification of the second light source, a processing module configured to:

determine perceivable first light attributes at the first based at least in part on the first light attributes and the second light attributes, and control the second light source based at least in part on the perceivable first light attributes and the specification of the second light source to provide the second light having perceivable second light attributes at the second location that substantially match the perceivable first light attributes at the first location.

2. The system of claim 1, wherein the processing module is further configured:

to calculate the surface color reflection spectrum from the first light attributes and the second light attributes, to compute an adjustment color spectrum from the calculated surface color reflection spectrum and the first and second light attributes, and to control the second light source based on the computed adjustment color spectrum.

3. The system of claim 2, wherein the processing module is further configured to calculate the surface color reflection spectrum from the first light attributes and the second light attributes by subtracting the color spectrum measured with the second sensor from the color spectrum measured with the first sensor.

4. The system of claim 1, wherein the first sensor is further configured to receive the second light substantially directly from the second light source and measure first light attributes of the second light, the second sensor is further configured to receive the second light at least partially reflected by one or more surfaces in the second location and measure second light attributes of the second light, and the processing module is further configured to determine perceivable second light attributes at the second location from the first light attributes and the second light attributes of the second light, and based at least partially on the perceivable second light attributes at the second location to adjust the second light source to provide the second light having perceivable second light attributes at the second location that substantially match the perceivable first light attributes at the first location.

5. The system of claim 4, wherein the adjustment of the second light source comprises iteratively repeating the following steps until the perceivable second light attributes of the second light at the second location differ from the perceivable first light attributes at the first location by a predefined minimum deviation:

measuring the first and second light attributes of the second light with the second light detector at the second location, transmitting the measured first and second light attributes to the processing means, processing the received first and second light attributes of the second light and the first and second light attributes of the first light in order to determine a deviation, and if the deviation exceeds the predefined minimum deviation, adjusting the second light source in correspondence with the processed deviation.

6. A method for copying an illumination pattern from a first location and reproducing said illumination pattern in a second location, the method comprising the steps of:

providing a first light from a first light source for illuminating the first location, providing a second light from a second light source for illuminating the second location, receiving the first light by a first sensor substantially directly from the first light source and measuring first light attributes of the first light, receiving the first light by a second sensor at least partially reflected by one or more surfaces in the first location and measuring second light attributes of the first light, storing a database in a memory including a specification of the second light source, processing perceivable first light attributes by a processing module at the first location from the first light attributes and the second light attributes, and, in conjunction with the specification of the second light source, controlling the second light source by the processing module to provide the second light having perceivable second light attributes at the second location that substantially match the perceivable first light attributes at the first location.

* * * * *